US007624860B2

(12) United States Patent
Roila et al.

(10) Patent No.: US 7,624,860 B2
(45) Date of Patent: Dec. 1, 2009

(54) RIGID HINGED-LID PACKAGE FOR TOBACCO ARTICLES

(75) Inventors: Patrizio Roila, San Mariano Di Corciano (IT); Roberto Polloni, Modigliana (IT)

(73) Assignee: G.D. Societa'per Azioni, Bologna (IT)

( * ) Notice: Subject to any disclaimer, the term of this patent is extended or adjusted under 35 U.S.C. 154(b) by 0 days.

(21) Appl. No.: 11/660,882

(22) PCT Filed: Aug. 25, 2005

(86) PCT No.: PCT/EP2005/054196

§ 371 (c)(1),
(2), (4) Date: Sep. 29, 2008

(87) PCT Pub. No.: WO2006/021581

PCT Pub. Date: Mar. 2, 2006

(65) Prior Publication Data

US 2009/0045084 A1 Feb. 19, 2009

(30) Foreign Application Priority Data

Aug. 26, 2004 (IT) ..... BO2004A0532

(51) Int. Cl.
*B65D 85/10* (2006.01)

(52) U.S. Cl. ..... 206/268; 206/273

(58) Field of Classification Search ..... 206/261, 206/265, 268, 271, 273, 1.5
See application file for complete search history.

(56) References Cited

U.S. PATENT DOCUMENTS

| | | | | |
|---|---|---|---|---|
| 1,992,373 | A * | 2/1935 | Johnson | 206/268 |
| 3,052,398 | A * | 9/1962 | Benjamin | 229/125.37 |
| 3,749,234 | A | 7/1973 | Gero | |
| 3,881,599 | A | 5/1975 | Flaherty | |
| 6,715,605 | B1 * | 4/2004 | Manservigi et al. | 206/268 |

FOREIGN PATENT DOCUMENTS

FR 1 208 736 2/1960

OTHER PUBLICATIONS

International Search Report in PCT/EP2005/054196 dated Jan. 11, 2006.

* cited by examiner

*Primary Examiner*—Jacob K Ackun, Jr.
(74) *Attorney, Agent, or Firm*—Marshall, Gerstein & Borun LLP

(57) ABSTRACT

A rigid package for tobacco articles has a parallelepiped-shaped container housing a group of tobacco articles and having a withdrawal opening; and a cup-shaped lid hinged to the container along a hinge to rotate, with respect to the container, between an open position and a closed position respectively opening and closing the withdrawal opening; the container and the lid are formed by folding two independent separate blanks.

45 Claims, 14 Drawing Sheets

RIGID HINGED-LID PACKAGE FOR TOBACCO ARTICLES

CROSS-REFERENCE TO RELATED APPLICATIONS

This is the U.S. national phase application of International Application No. PCT/EP2005/054196, filed Aug. 25, 2005, which claims the benefit of Italian patent application No. BO2004A000532, filed Aug. 26, 2004.

TECHNICAL FIELD

The present invention relates to a rigid, hinged-lid package for tobacco articles.

The present invention may be used to particular advantage in a rigid cigarette packet, to which the following description refers purely by way of example.

BACKGROUND ART

Rigid, hinged-lid cigarette packets are currently the most widely marketed, by being easy to make, easy and practical to use, and providing good mechanical protection of the cigarettes inside.

A rigid, hinged-lid cigarette packet comprises a cup-shaped container having an open top end; and a cup-shaped lid hinged to the container along a hinge to rotate, with respect to the container, between an open position and a closed position respectively opening and closing the open end. A rigid, hinged-lid cigarette packet of the type described above is normally produced by folding a single, flat, substantially elongated rectangular blank about a respective group of cigarettes wrapped in a sheet of foil; in which case, the lid and container both form part of the same blank. A collar, separate from the flat blank, is normally fitted, folded into a U, inside the container, and projects partly outwards of the open end to engage a corresponding inner surface of the lid when the lid is in the closed position.

Rigid, hinged-lid cigarette packets of the type described above have various drawbacks, in that they tend to lose shape and fail to provide for adequate mechanical protection of the cigarettes inside when subjected to relatively severe mechanical stress (as, for example, when carried in the user's trouser pocket). Moreover, accidental opening of the lid is fairly common, thus resulting in fallout of the cigarettes.

U.S. Pat. No. 3,881,599A1 discloses a cigarette package comprising an outer shell, in which an inner shell is mounted to swing relative to the outer shell; the inner shell houses cigarettes and is movable from a position completely enclosed within the outer shell, to an angular position, relative to the outer shell, wherein a portion of the top of the inner shell is exposed laterally of the outer shell to permit extraction of the cigarettes from the inner shell.

DISCLOSURE OF INVENTION

It is an object of the present invention to provide a rigid package for tobacco articles, which is easier and more practical to use than known packages, has none of the aforementioned drawbacks, and, at the same time, is cheap and easy to produce.

According to the present invention, there is provided a rigid package for tobacco articles, as recited in the accompanying claims.

BRIEF DESCRIPTION OF THE DRAWINGS

A number of non-limiting embodiments of the present invention will be described by way of example with reference to the accompanying drawings, in which.

PREFERRED EMBODIMENT OF THE INVENTION

Figures 1, 2:
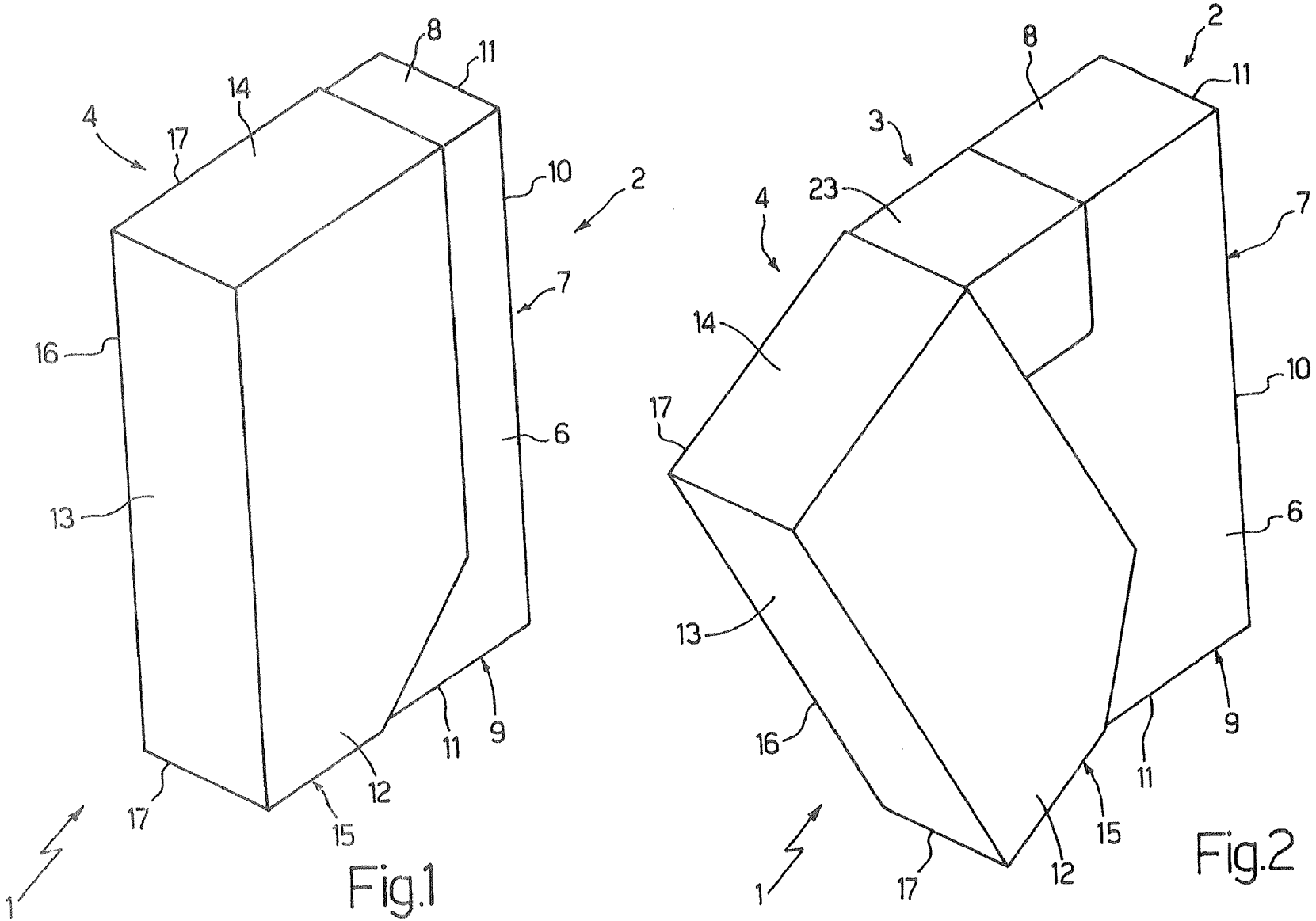
FIG. 1 shows a front view in perspective of a rigid cigarette packet in accordance with the present invention and in a closed configuration.
FIG. 2 shows a front view in perspective of the FIG. 1 rigid cigarette packet in an open configuration.

Number 1 in FIG. 1 indicates as a whole a rigid packet of cigarettes containing an orderly, parallelepiped-shaped group of cigarettes (not shown for clarity) wrapped in a sheet of foil packing material.

Packet 1 comprises a parallelepiped-shaped container 2 housing the group of cigarettes and having a cigarette withdrawal opening 3 at a top end; and a cup-shaped lid 4 hinged to container 2 along a hinge 5 (shown in FIGS. 3 and 4) to rotate, with respect to container 2, between an open position and a closed position respectively opening and closing withdrawal opening 3.

Container 2 comprises two opposite parallel major lateral walls 6; two opposite parallel minor lateral walls 7 crosswise to major lateral walls 6; a top wall 8; and a bottom wall 9 opposite and parallel to top wall 8. Four longitudinal edges 10 are defined between major lateral walls 6 and minor lateral walls 7, and eight transverse edges 11 are defined between lateral walls 6, 7 and walls 8, 9. More specifically, transverse edges 11 are divided into four major transverse edges 11 defined between major lateral walls 6 and walls 8, 9, and four minor transverse edges 11 defined between minor lateral walls 7 and walls 8, 9. As shown in the accompanying drawings, longitudinal edges 10 and transverse edges 11 are all sharp square edges.

Lid 4 is in the form of a substantially parallelepiped-shaped cup, and comprises two opposite parallel major lateral walls 12; a minor lateral wall 13 crosswise to major lateral walls 12; a top wall 14; and a bottom wall 15 opposite and parallel to top wall 14. Two longitudinal edges 16 are defined between major lateral walls 12 and minor lateral wall 13, and six transverse edges 17 are defined between lateral walls 12, 13 and walls 14, 15. More specifically, transverse edges 17 are divided into four major transverse edges 17 defined between major lateral walls 12 and walls 14, 15, and two minor transverse edges 17 defined between minor lateral wall 13 and walls 14, 15, As shown in the accompanying drawings, longitudinal edges 16 and transverse edges 17 are all sharp square edges.

It is important to point out that minor lateral wall 13 of lid 4 is substantially the same size as minor lateral walls 7 of container 2, and the major lateral walls of the lid are smaller than major lateral walls 6 of container 2, so that lid 4 is smaller than container 2 to completely cover withdrawal opening 3 through top wall 8 of container 2 without completely covering top wall 8 of container 2. The purpose of the above reduction in the size of lid 4 is to save packing material.

Each major lateral wall 12 of lid 4 preferably comprises a triangular-bevelled bottom portion, on account of top wall 14 of lid 4 normally being larger than bottom wall 15.

Container 2 and lid 4 are formed by folding two independent separate blanks 18 and 19 (FIGS. 5 and 6) respectively. Lid 4 is glued to bottom wall 9 of container 2, so that hinge 5 is parallel to the minor transverse edges 11 of container 2 defined between minor lateral walls 7 and walls 8, 9. Hinge 5 is preferably located, on bottom wall 9 of container 2, in an intermediate position between the two minor transverse edges 11 bounding bottom wall 9. When lid 4 is in the closed position, top wall 14 of lid 4 is positioned contacting top wall 8 of container 2 and covers withdrawal opening 3, and bottom wall 15 of lid 4 is positioned contacting bottom wall 9 of container 2.

Lid 4 comprises a connecting tab 20 separated from lid 4 by a fold line defining hinge 5, and which is glued entirely to bottom wall 9 of container 2. Connecting tab 20 is preferably glued to bottom wall 9 of container 2 so as to be interposed between bottom wall 9 of container 2 and bottom wall 15 of lid 4 when lid 4 is in the closed position.

Figure 4:
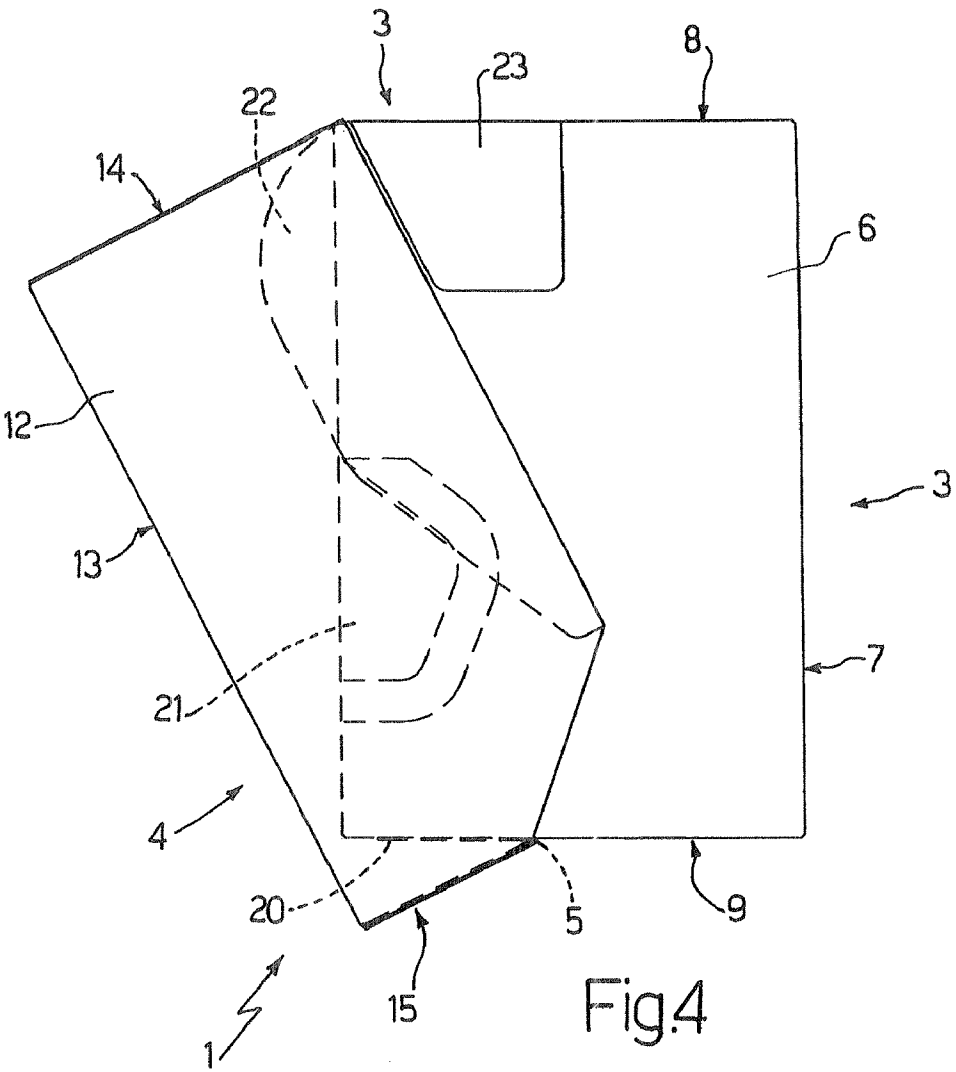
FIG. 4 shows a front view of the FIG. 1 rigid cigarette packet in an open configuration, and with various internal components of the packet shown by dash lines.
Figure 3:
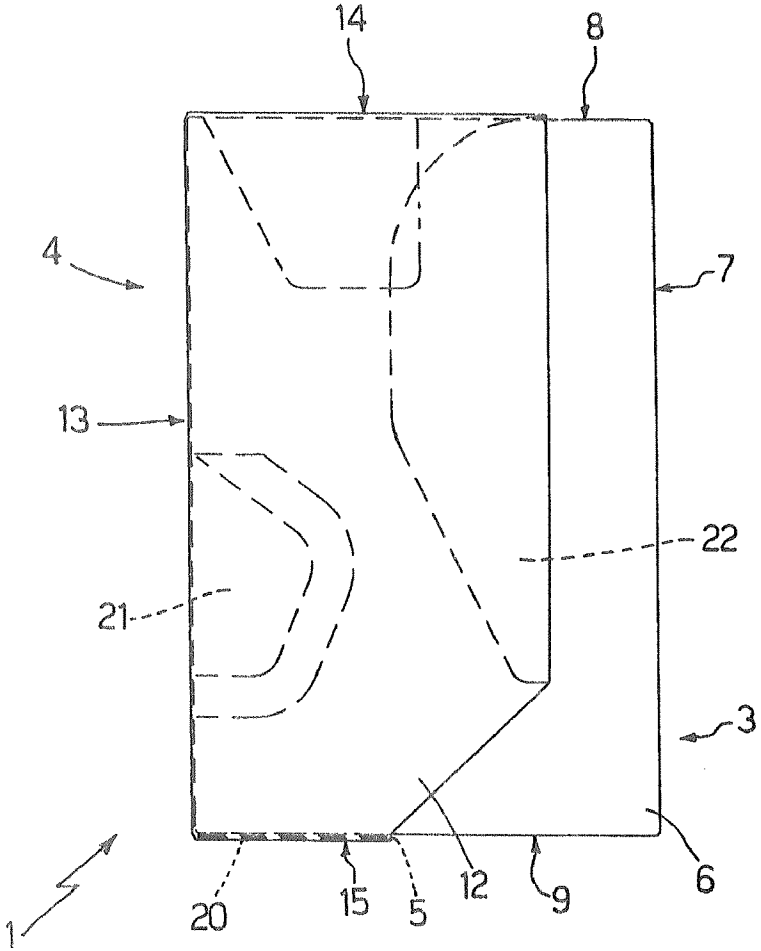
FIG. 3 shows a front view of the FIG. 1 rigid cigarette packet in a closed configuration, and with various internal components of the packet shown by dash lines.

As shown in FIGS. 3 and 4, a stop member is provided to limit rotation of lid 4 with respect to container 2 and so define a maximum open position (shown in FIG. 4), and comprises two stop tabs 21, each projecting outwards of container 2 from a respective major lateral wall 6 of container 2, and two stop tabs 22, each projecting inwards of lid 4 from a respective major lateral wall 12 of lid 4 and positioned to engage a respective stop tab 21 as lid 4 is opened.

As shown in the accompanying drawings, each stop tab 21 is formed by removing a strip of material from a respective major lateral wall 6 of container 2. In a different embodiment not shown, each stop tab 21 is formed by making an incision in a respective major lateral wall 6 of container 2.

Withdrawal opening 3 preferably extends over part of top wall 8 of container 2 and part of major lateral walls 6 of container 2, so that the cigarettes can be withdrawn quickly and easily through opening 3. As shown in the accompanying drawings, withdrawal opening 3 is closed by a tear-off portion 23 of container 2. Tear-off portion 23 may close the whole of withdrawal opening 3, as shown in the accompanying drawings, or only part of withdrawal opening 3. In the latter case, tear-off portion 23 leaves part of withdrawal opening 3 at major lateral walls 6 exposed to permit easy grip and removal of tear-off portion 23 from container 2 by the user when unsealing packet 1.

In a different embodiment not shown, minor lateral wall 13 of lid 4 has at least one through hole large enough to permit insertion of a user's finger, and which facilitates opening of lid 4 by enabling the user to one-handedly impart a relative opening movement between lid 4 and container 2.

Figure 5:
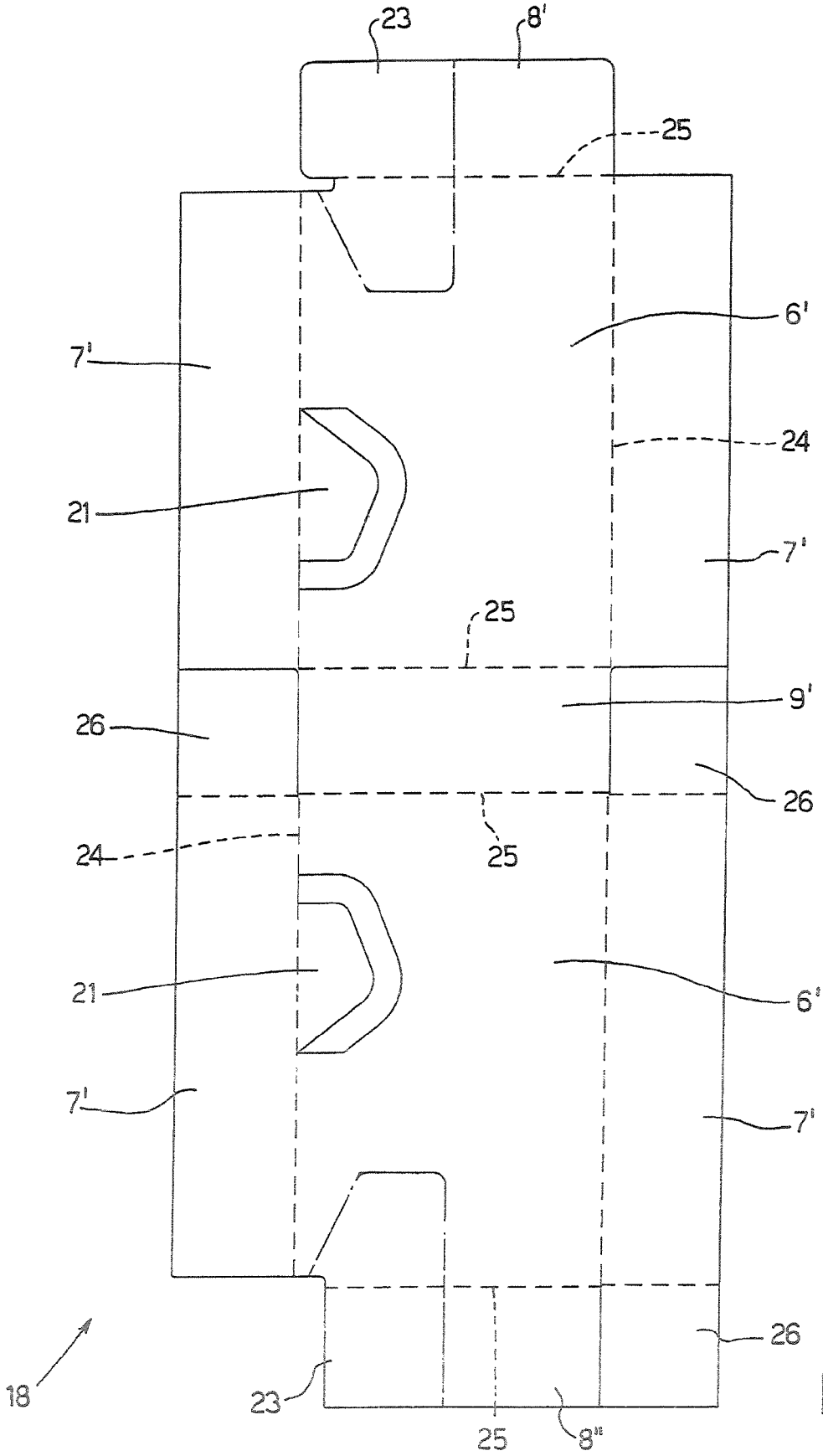
FIG. 5 shows a plan view of a first blank by which to produce the FIG. 1 rigid cigarette packet.

As shown in FIG. 5, container 2 is formed by folding flat, substantially elongated rectangular blank 18, the component parts of which are indicated, where possible, using the same reference numbers, with superscripts, as for the corresponding parts of container 2.

Blank 18 comprises two longitudinal fold lines 24, and a number of transverse fold lines 25 defining, between the two longitudinal fold lines 24, a panel 8' defining part of top wall 8; a panel 6' defining one major lateral wall 6; a panel 9' defining bottom wall 9; a panel 6' defining the other major lateral wall 6; and a panel 8" defining the rest of top wall 8. Each panel 6' has two wings 7', which define respective parts of minor lateral walls 7, are located on opposite sides of panel 6', and are separated from panel 6' by longitudinal fold lines 24. A first wing 7' of one panel 6' has two tabs 26 separated from wing 7' by transverse fold lines 25; and a second wing 7' of the same panel 6' has one tab 26 separated from wing 7' by a transverse fold line 25 and substantially aligned with panel 9'.

Figure 6:
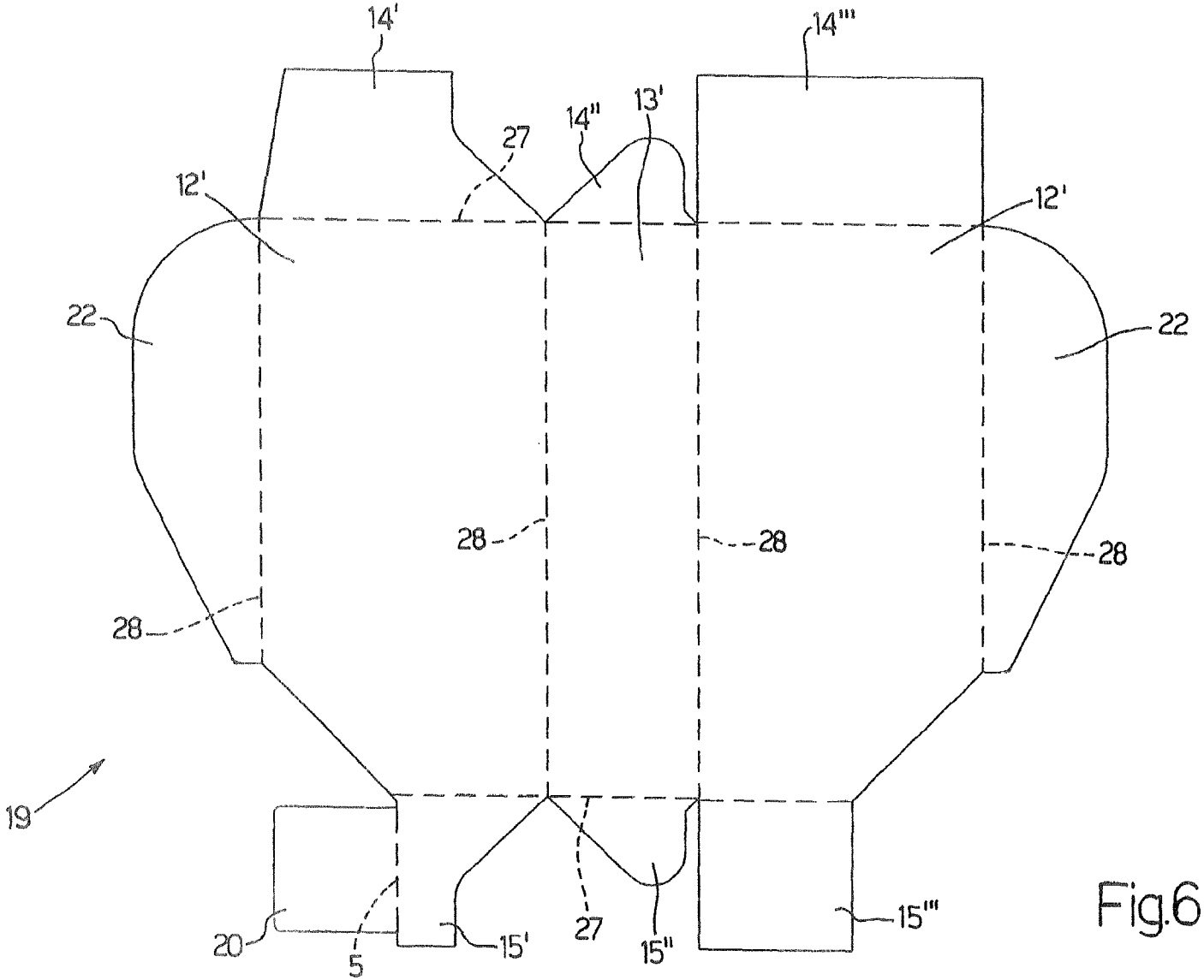
FIG. 6 shows a plan view of a second blank by which to produce the FIG. 1 rigid cigarette packet.
Figure 8:
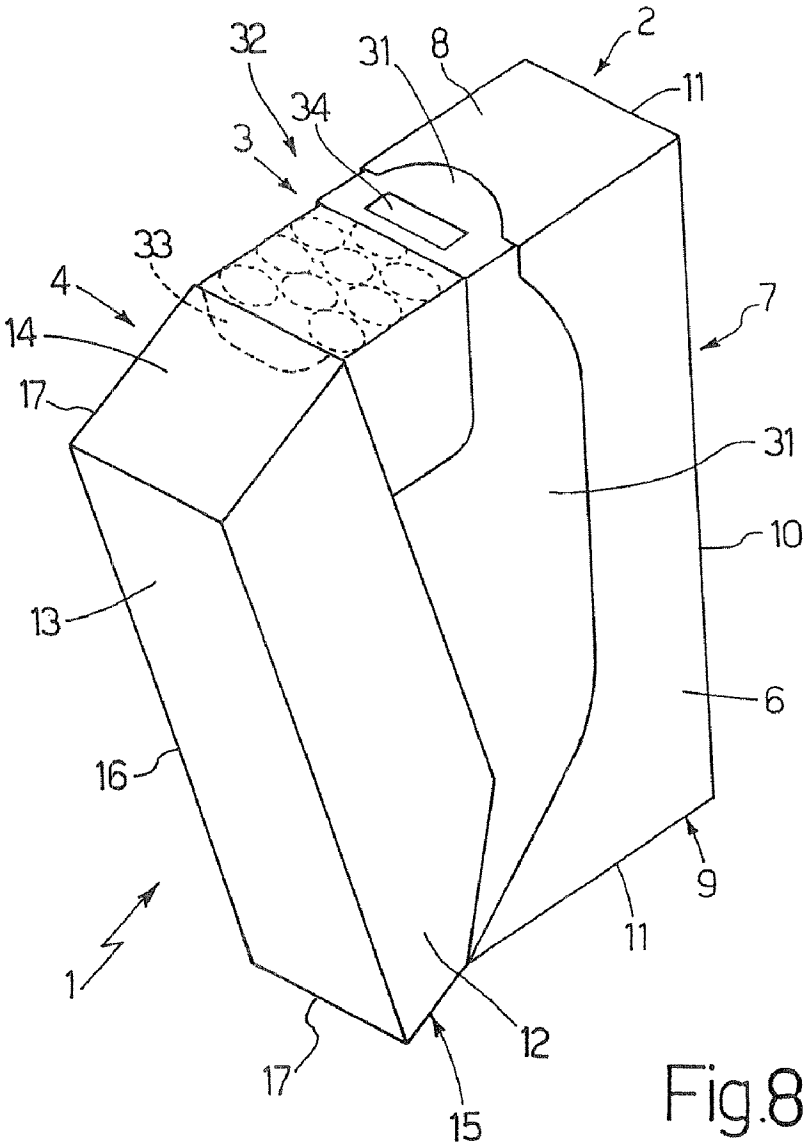
FIG. 8 shows a front view in perspective of the FIG. 7 rigid cigarette packet in an open configuration.
Figure 7:
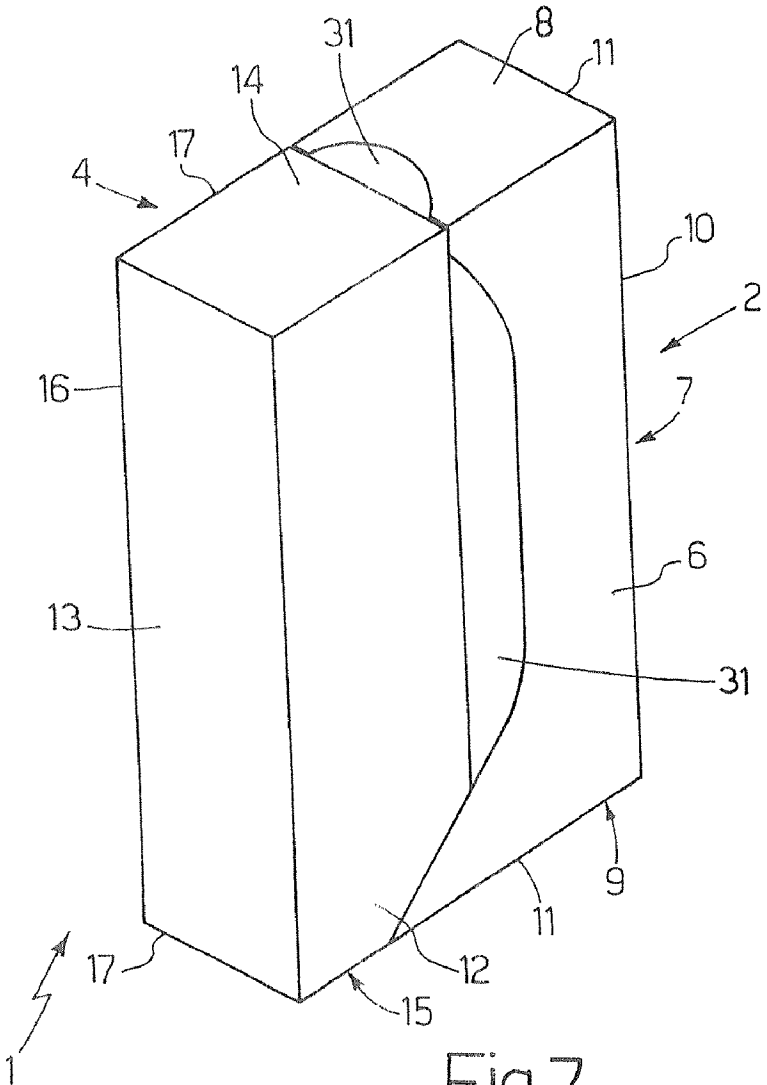
FIG. 7 shows a front view in perspective of a further rigid cigarette packet in accordance with the present invention and in a closed configuration.

As shown in FIG. 6, lid 4 is formed by folding flat, substantially elongated rectangular blank 19, the component parts of which are indicated, where possible, using the same reference numbers, with superscripts, as for the corresponding parts of lid 4.

Blank 19 has two transverse fold lines 27, and a number of longitudinal fold lines 28 defining, between transverse fold lines 27, a panel 12' defining one major lateral wall 12; a panel 13' defining minor lateral wall 13; and a panel 12' defining the other major lateral wall 12. One panel 12' has two wings 14' and 15' located at opposite ends of panel 12', separated from panel 12' by transverse fold lines 27, and defining respective inner portions of walls 14 and 15; panel 13' has two wings 14" and 15" located at opposite ends of panel 13', separated from panel 13' by transverse fold lines 27, and defining respective inner portions of walls 14 and 15; and the other panel 12' has two wings 14'" and 15'" located at opposite ends of panel 12', separated from panel 12' by transverse fold lines 27, and defining respective outer portions of walls 14 and 15.

Wings 14', 15', 14", 15" are shaped so as not to overlap when folded onto wings 14'" and 15'" to define walls 14 and 15 of lid 4. Connecting tab 20 is connected to wing 15' of panel 12' and separated from wing 15' by a fold line defining hinge 5 and parallel to longitudinal fold lines 28.

FIGS. 7-10 show a different embodiment of packet 1 described above. The main difference between packet 1 in FIGS. 1-4 and packet 1 in FIGS. 7-10 lies in lid 4 of packet 1 in FIGS. 7-10 being connected seamlessly to container 2, as opposed to being glued to container 2, in particular to bottom wall 9 of container 2.

Moreover, container 2 of packet 1 in FIGS. 7-10 has no minor lateral wall 7 at lid 4, and so only comprises the minor lateral wall 7 on the opposite side to lid 4.

Major lateral walls 6 and top wall 8 of container 2 of packet 1 in FIGS. 7-10 are formed by superimposing two panels of two different, separate, independent blanks 29 and 30 (shown in FIGS. 11 and 12), and comprise recesses 31 formed by using only one panel in those areas, and which make lid 4 easier to open by enabling the user to push the edges of lid 4.

Packet 1 in FIGS. 7-10 comprises a retaining device 32 for retaining lid 4 in the closed position with a given force, so that greater force is required to open lid 4, thus preventing lid 4 from opening accidentally. Retaining device 32 comprises a deformable tab 33 at one edge of top wall 14 of lid 4; and a seat 34 formed on top wall 8 of container 2. In actual use, tab 33 is inserted inside seat 34 and, to be extracted from seat 34, must be deformed by applying a given force.

Figure 10:
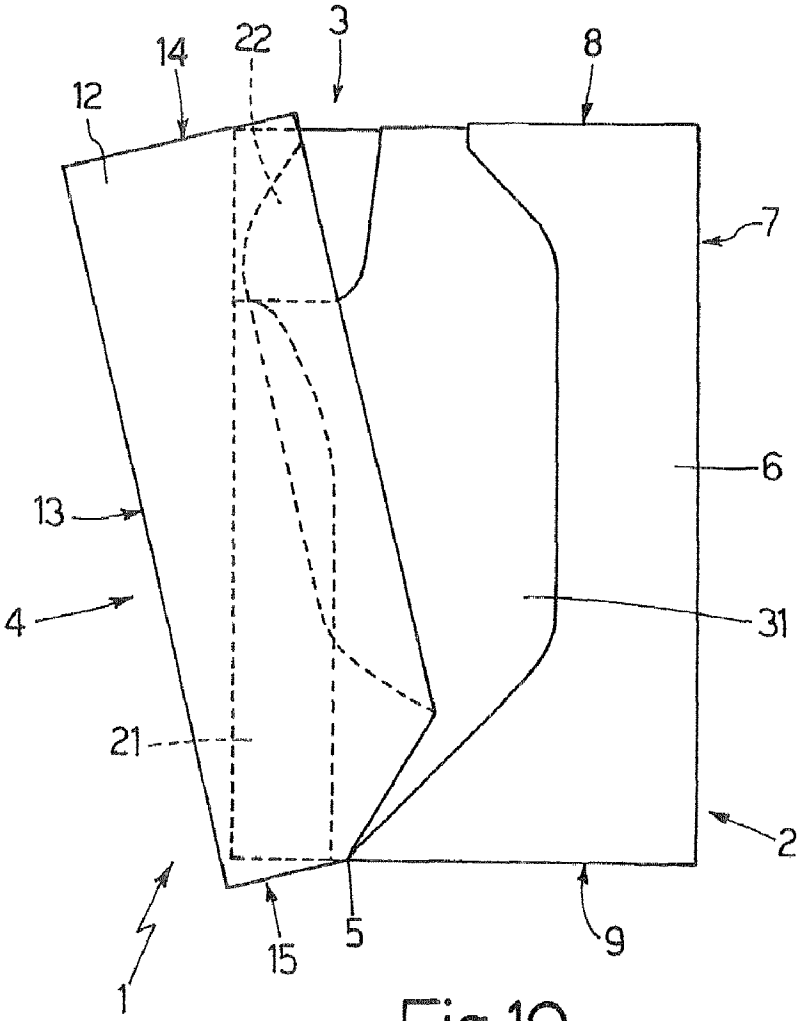
FIG. 10 shows a front view of the FIG. 7 rigid cigarette packet in an open configuration, and with various internal components of the packet shown by dash lines.
Figure 9:
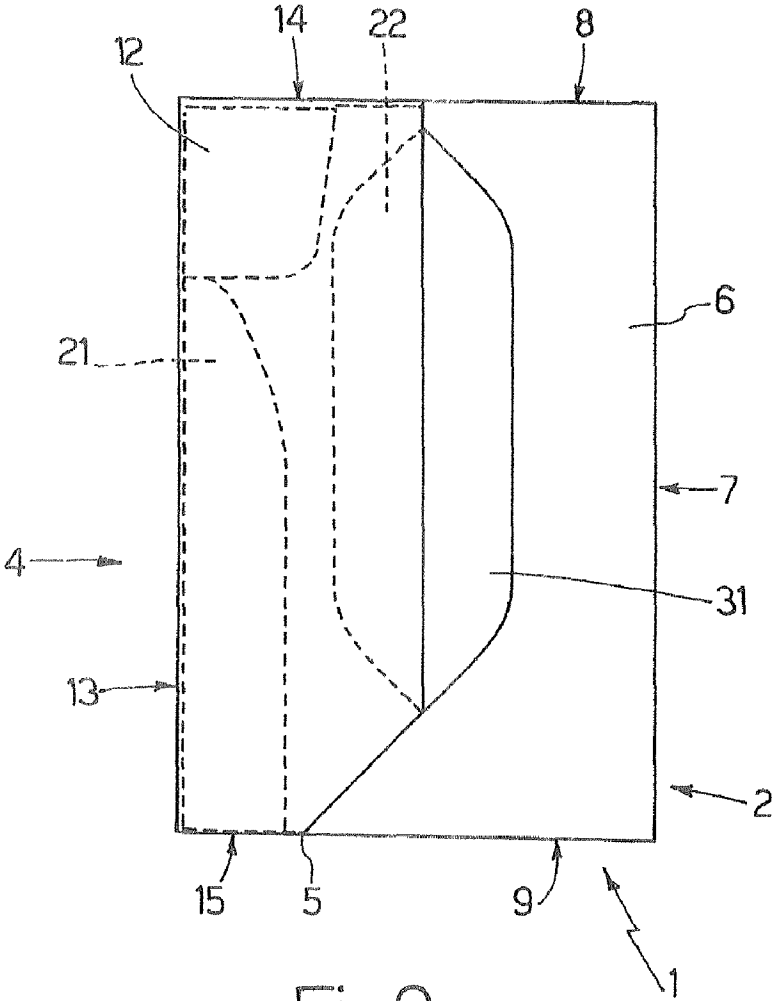
FIG. 9 shows a front view of the FIG. 7 rigid cigarette packet in a closed configuration, and with various internal components of the packet shown by dash lines.

FIGS. 9 and 10 show the stop member of packet 1 in FIGS. 7-10. The stop member is provided to limit rotation of lid 4 with respect to container 2 and so define a maximum open position (shown in FIG. 8), and comprises two stop tabs 21, each projecting outwards of container 2 from a respective major lateral wall 6 of container 2, and two stop tabs 22, each projecting inwards of lid 4 from a respective major lateral wall 12 of lid 4 and positioned to engage a respective stop tab 21 as lid 4 is opened.

Figure 11:
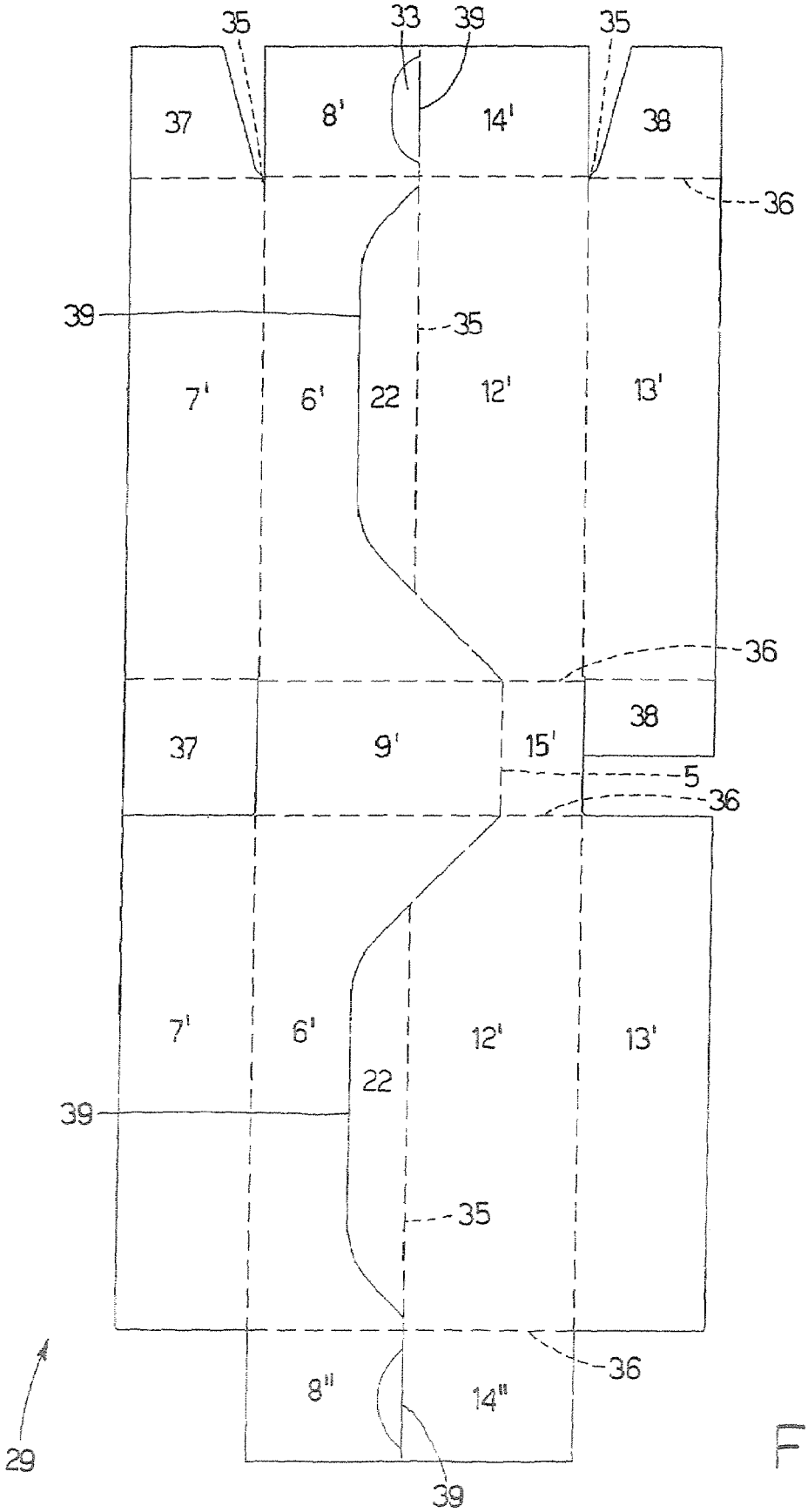
FIG. 11 shows a plan view of a first blank by which to produce the FIG. 7 rigid cigarette packet.
Figure 12:
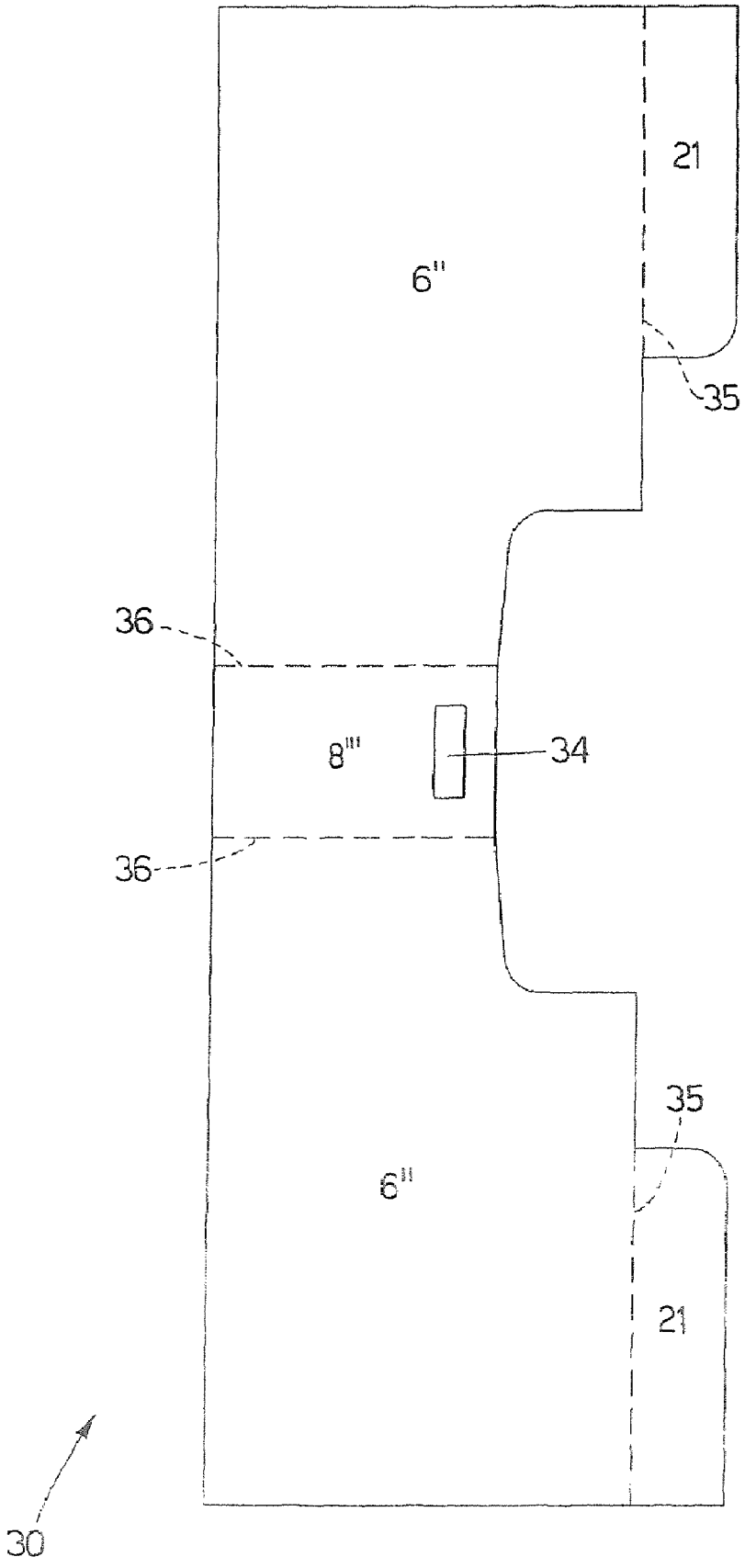
FIG. 12 shows a plan view of a second blank by which to produce the FIG. 7 rigid cigarette packet.

As shown in FIGS. 11 and 12, packet 1, i.e. container 2 and lid 4, are formed by folding blanks 29 and 30, which are flat and substantially in the form of elongated rectangles, and the component parts of which are indicated, where possible, using the same reference numbers, with superscripts, as for the corresponding component parts of container 2 and lid 4.

Blank 29 in FIG. 11 comprises two longitudinal fold lines 35, and a number of transverse fold lines 36 defining, between the two longitudinal fold lines 35, a panel 8' and 14' defining part of top wall 8 of container 2 and part of top wall 14 of lid 4; a panel 6' and 12' defining one major lateral wall 6 of container 2 and one major lateral wall 12 of lid 4; a panel 9' and 15' defining bottom wall 9 of container 2 and bottom wall 15 of lid 4; a panel 6' and 12' defining the other major lateral wall 6 of container 2 and the other major lateral wall 12 of lid 4; and a panel 8" and 14" defining the rest of top wall 8 of container 2 and the rest of top wall 14 of lid 4.

Each panel 6' and 12' has two wings 7' and 13', which define respective parts of minor lateral wall 7 of container 2 and of minor lateral wall 13 of lid 4, are located on opposite sides of panel 6' and 12', and are separated from panel 6' and 12' by longitudinal fold lines 35. Wing 7' of one panel 6' and 12' has two tabs 37 separated from wing 7' by transverse fold lines 36; and wing 13' of the same panel 6' and 12' has two tabs 38 separated from wing 13' by transverse fold lines 36.

Hinge 5 extends along panel 9' and 15' and separates the component parts of container 2 from the component parts of lid 4. A separating line 39 extends along panel 8' and 14', panels 6' and 12', and panel 8" and 14", and separates the component parts of container 2 from the component parts of lid 4. Most of separating line 39 defines an actual separation, while parts of separating line 39, in particular close to panel 9' and 15' and close to the outer edges of panels 8' and 14' and 8" and 14", define a preformed tear line. The purpose of the tear portions of separating line 39 is to ensure sufficient mechanical stability of blank 29 when handling and folding blank 29.

A stop tab 22 is formed inside each panel 6' and 12', and is defined on one side by separating line 39 and on the other side by a longitudinal fold line 35.

Blank 30 in FIG. 12 comprises a central panel 8'", which defines an inner part of top wall 8 of container 2; and two end panels 6", which define respective inner parts of major lateral walls 6 of container 2, are located at opposite ends of central panel 8'", and are separated from central panel 8'" by two transverse fold lines 36. Each end panel 6" has a stop tab 21, which is separated from end panel 6" by a longitudinal fold line 35.

It should be pointed out that blanks 29 and 30 described above are substantially the same shape and size and have substantially the same type of folds as a standard blank and relative collar for producing an ordinary rigid, hinged-lid packet, so that packet 1 in FIGS. 7-10 can be produced on a standard packing machine with very few alterations.

Figure 13:
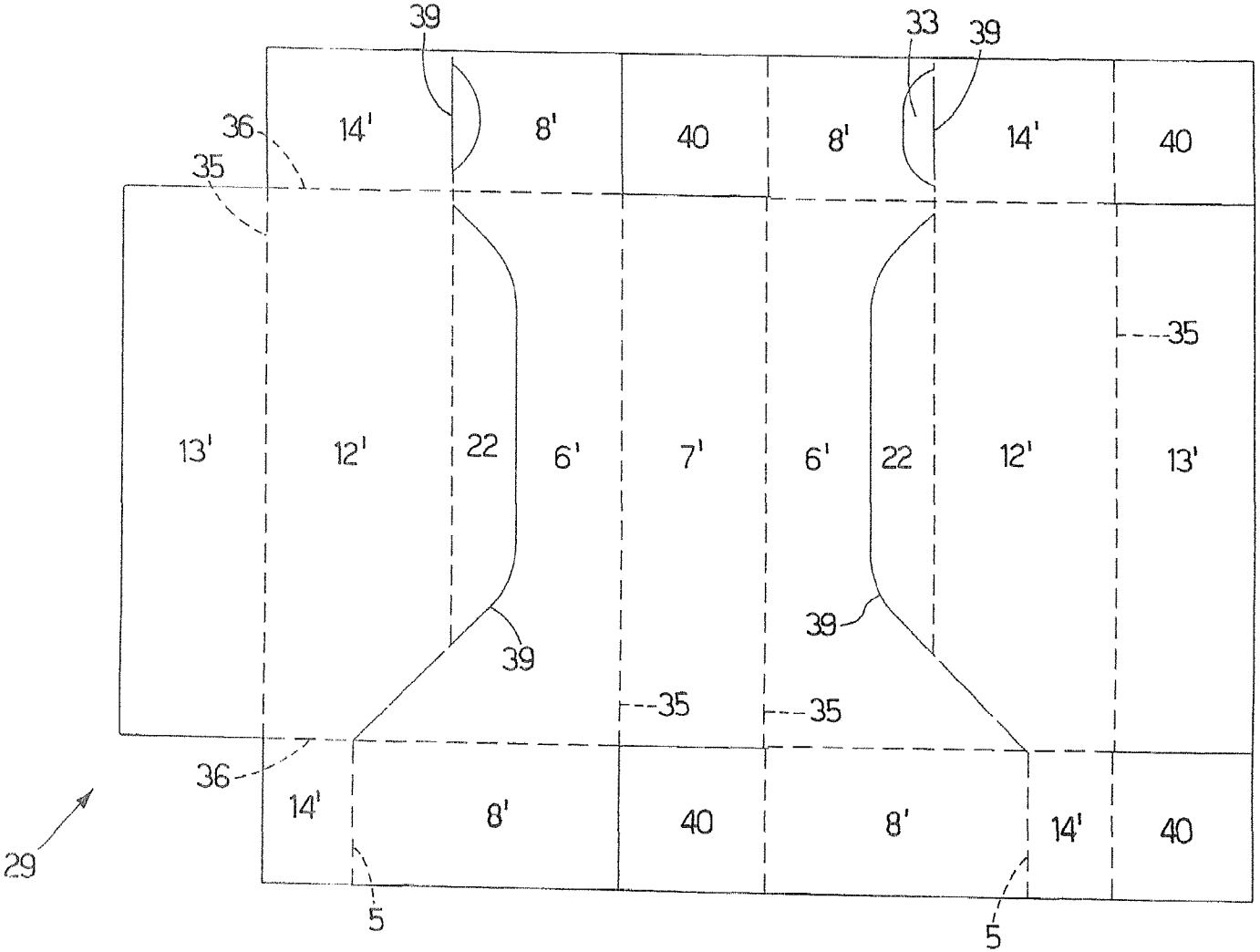
FIG. 13 shows a plan view of a further embodiment of the first blank shown in FIG. 11.
Figure 15:
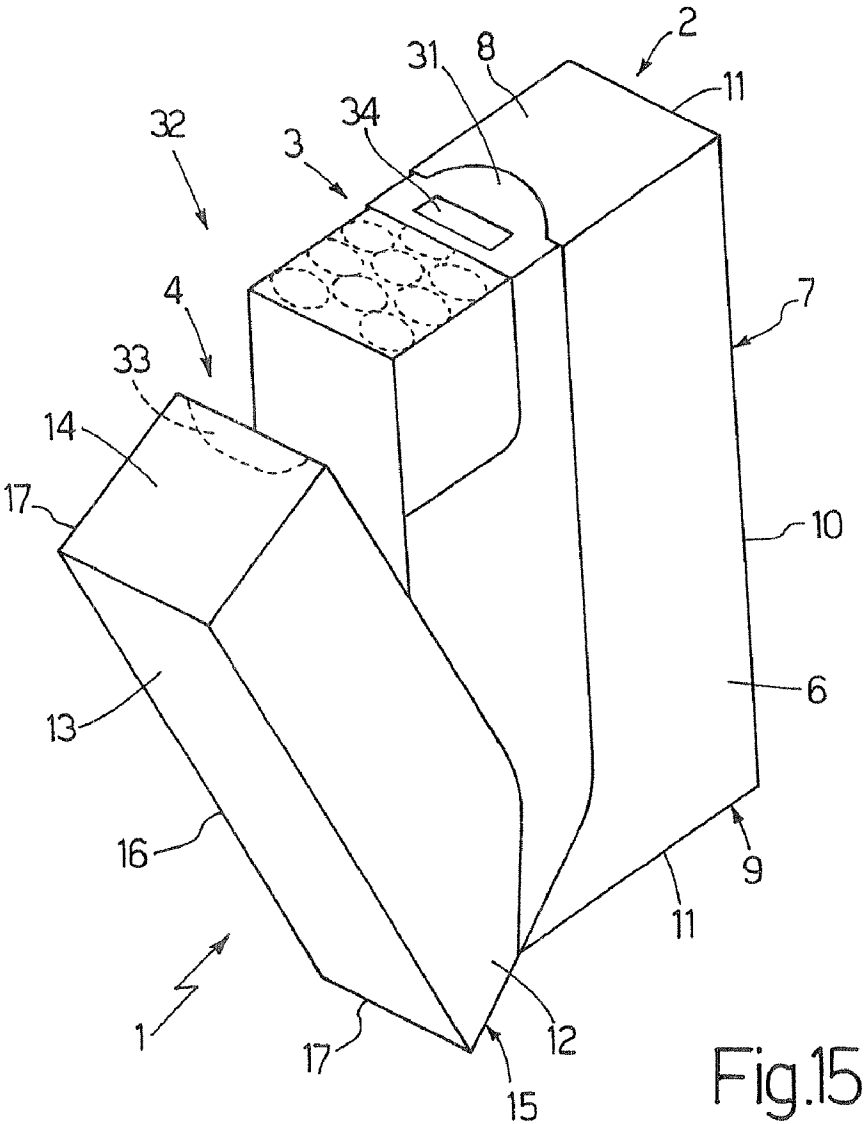
FIG. 15 shows a front view in perspective of the FIG. 14 rigid cigarette packet in an open configuration.
Figure 14:
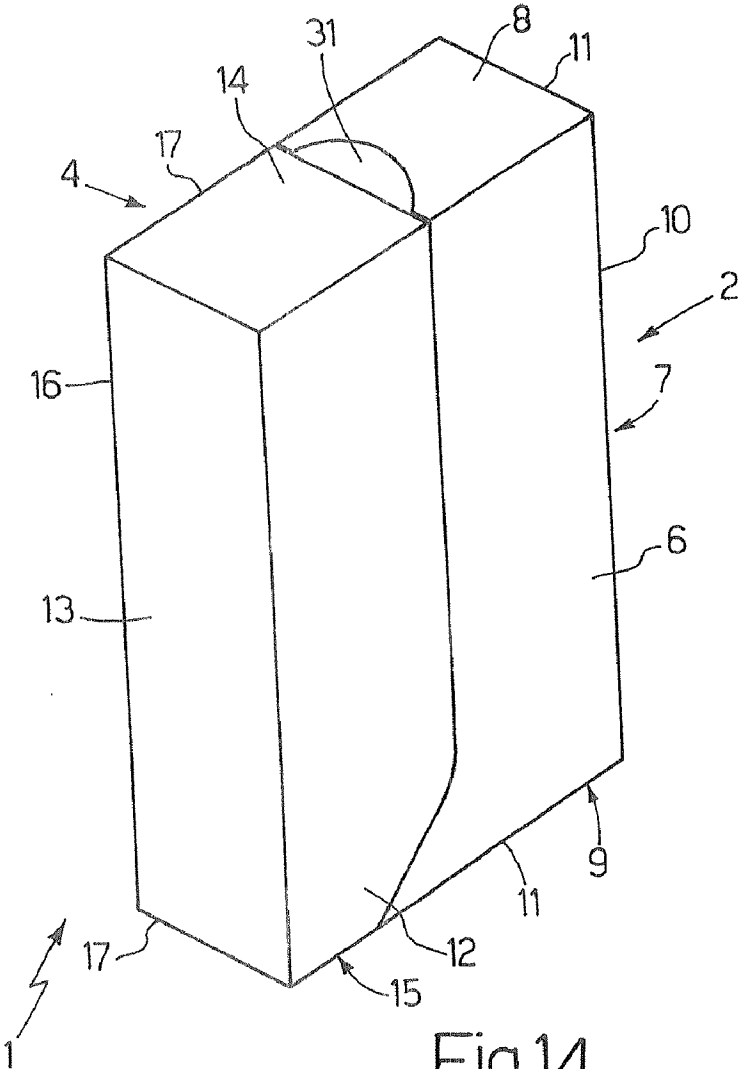
FIG. 14 shows a front view in perspective of a rigid cigarette packet in accordance with the present invention and in a closed configuration.
Figure 17:
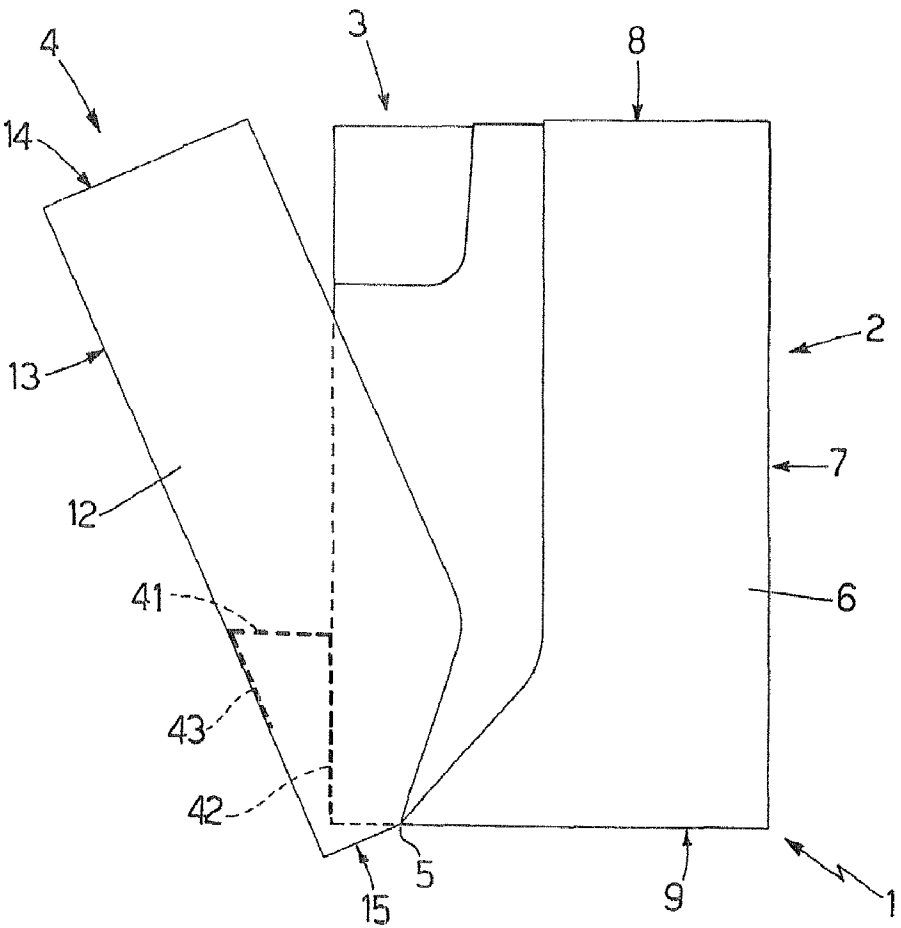
FIG. 17 shows a front view of the FIG. 14 rigid cigarette packet in an open configuration, and with various internal components of the packet shown by dash lines.
Figure 16:
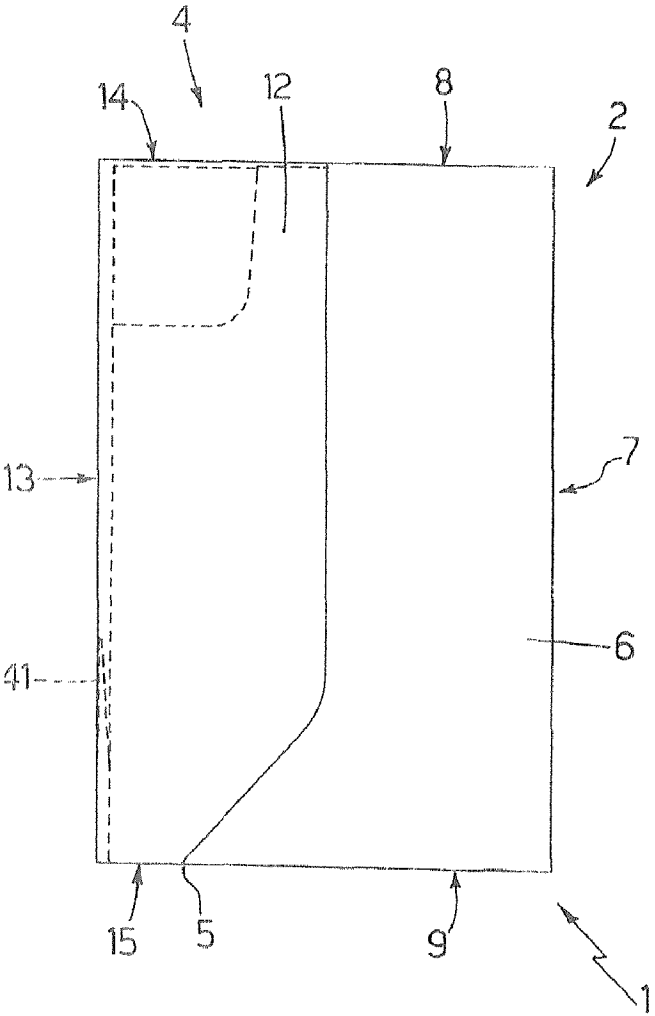
FIG. 16 shows a front view of the FIG. 14 rigid cigarette packet in a closed configuration, and with various internal components of the packet shown by dash lines.

FIG. 13 shows an alternative embodiment of the FIG. 11 blank 29, and which also combines with the FIG. 12 blank 30.

Blank 29 in FIG. 13 comprises two transverse fold lines 36, and a number of longitudinal fold lines 35 defining, between the two transverse fold lines 36, a panel 13' defining part of lateral wall 13 of lid 4; a panel 6' and 12' defining one major lateral wall 6 of container 2 and one major lateral wall 12 of lid 4; a panel 7' defining minor lateral wall 7 of container 2; a panel 6' and 12' defining the other major lateral wall 6 of container 2 and the other major lateral wall 12 of lid 4; and a panel 13' defining the rest of lateral wall 13 of lid 4.

Each panel 6' and 12' has two wings 8' and 14', which define respective parts of top wall 8 of container 2 and part of top wall 14 of lid 4, are located at opposite ends of panel 6' and 12', and are separated from panel 6' and 12' by transverse fold lines 36. Each wing 8' and 14' of one panel 6' and 12' has two tabs 40 located on opposite sides of wing 8' and 14' and separated from wing 8' and 14' by longitudinal fold lines 35.

FIGS. 14-17 show a variation of packet 1 in FIGS. 7-10. Packet 1 in FIGS. 14-17 differs in two respects from packet 1 in FIGS. 7-10: by having no recesses 31 on major lateral walls 6 and top wall 8, and by having a different stop member to limit rotation of lid 4 with respect to container 2 and so define a maximum open position (shown in FIG. 17).

The stop member of packet 1 in FIGS. 14-17 comprises a stop tab 41 located between lid 4 and container 2 and having one end hinged to container 2 and an opposite end hinged to lid 4. In a preferred embodiment shown more clearly in FIG. 17, the stop member comprises a supporting tab 42 connected longitudinally and seamlessly to a major lateral wall 6 of container 2 and hinged transversely to stop tab 41; and a supporting tab 43 glued to an inner surface of minor lateral wall 13 of lid 4 and hinged transversely to stop tab 41. When lid 4 is in the closed position (shown in FIG. 16), stop tab 41 is parallel to minor lateral wall 7 of container 2 and to minor lateral wall 13 of lid 4, and is located between minor lateral wall 13 of lid 4 and the group of cigarettes. When lid 4 is in the fully-open position (shown in FIG. 17), stop tab 41 is substantially perpendicular to minor lateral wall 7 of container 2, and slopes with respect to minor lateral wall 13 of lid 4.

Figure 18:
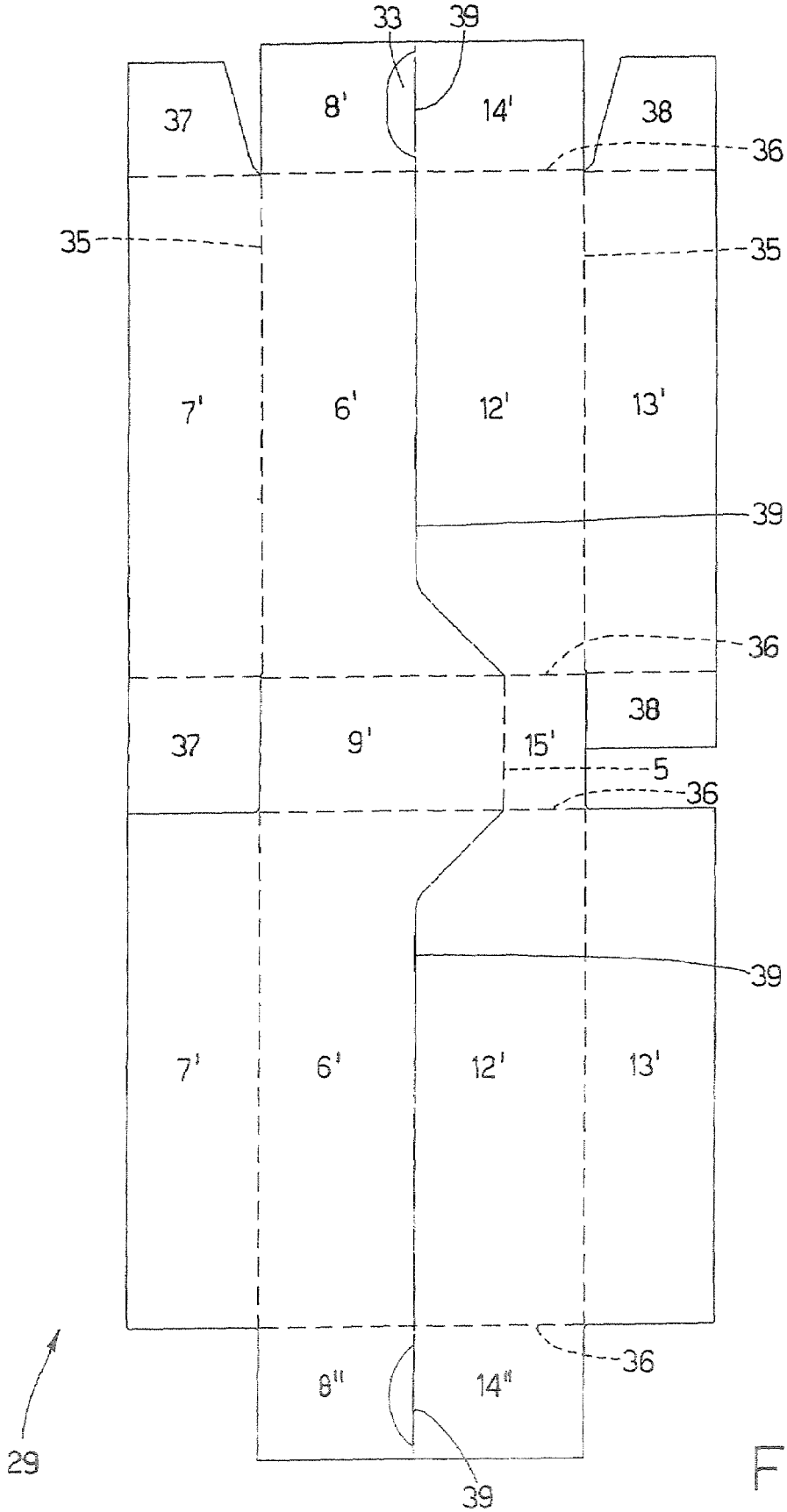
FIG. 18 shows a plan view of a first blank by which to produce the FIG. 14 rigid cigarette packet.

Blank 29 in FIG. 18 is very similar to blank 29 in FIG. 11, the foregoing description of which is therefore referred to for details of blank 29 in FIG. 18.

Figure 19:
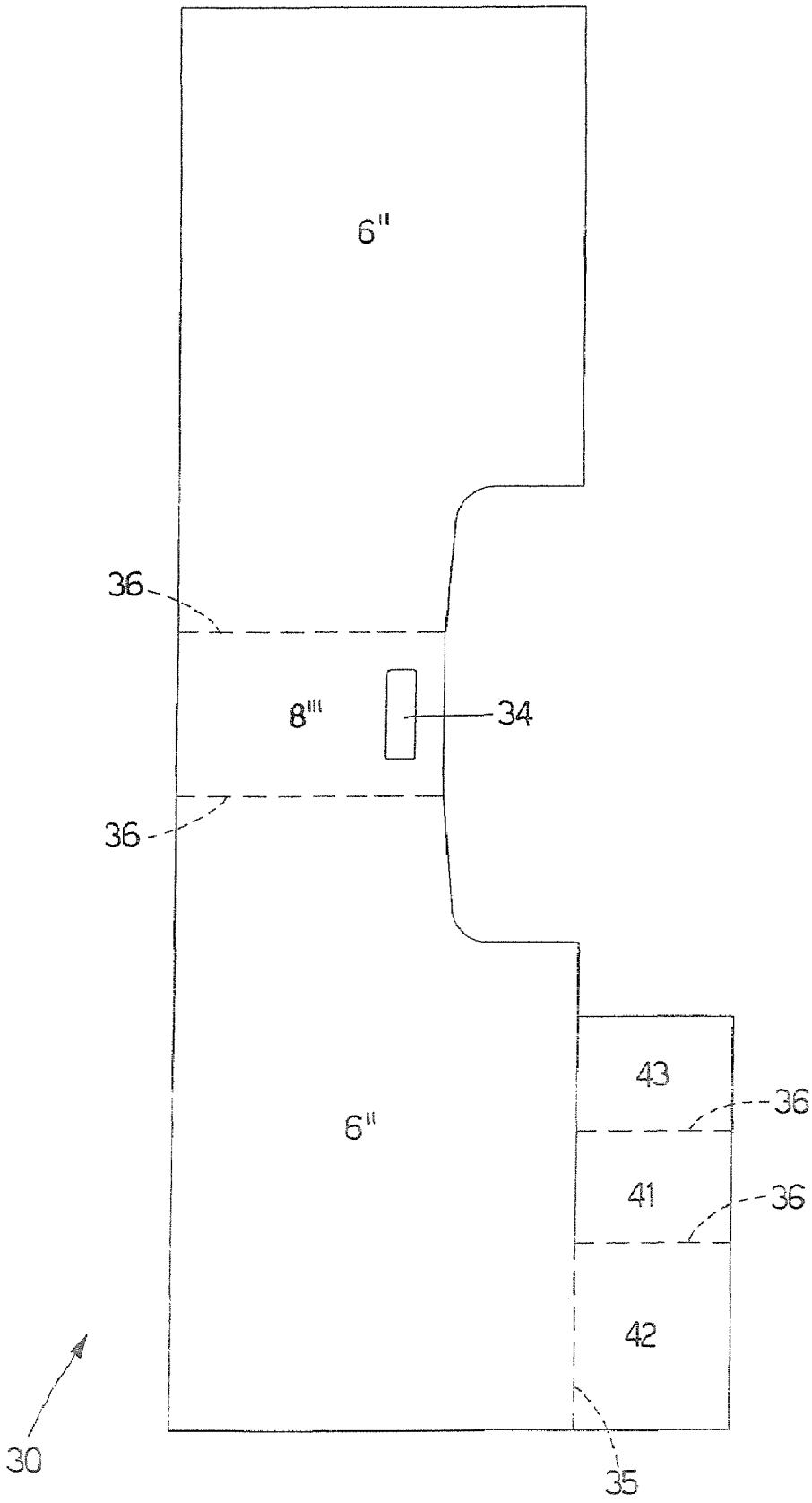
FIG. 19 shows a plan view of a second blank by which to produce the FIG. 14 rigid cigarette packet.

Blank 30 in FIG. 19 is very similar to blank 30 in FIG. 12, the foregoing description of which is therefore referred to for details of blank 30 in FIG. 19.

Figure 20:
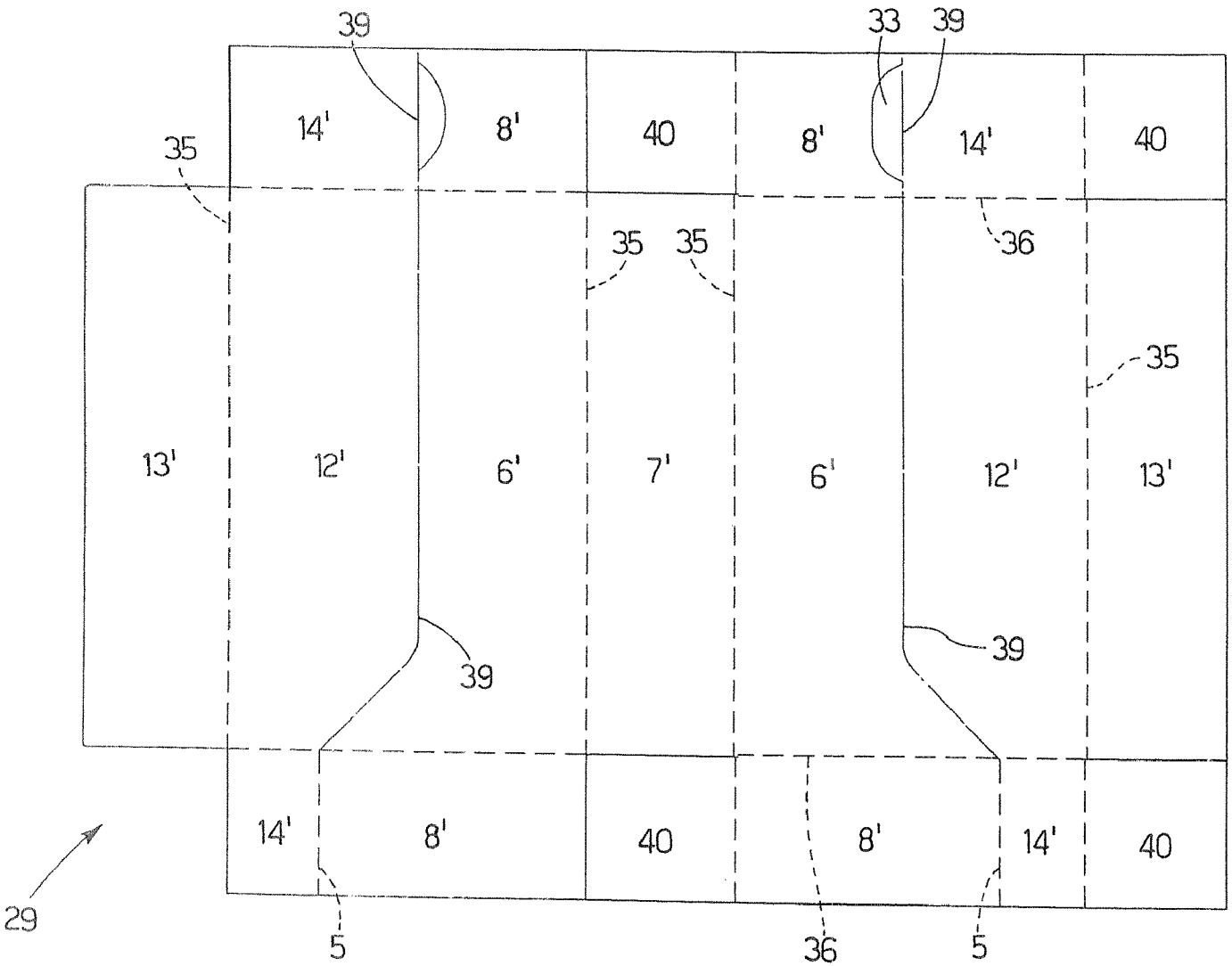
FIG. 20 shows a plan view of a further embodiment of the first blank shown in FIG. 18.

Blank 29 in FIG. 20 is very similar to blank 29 in FIG. 13, the foregoing description of which is therefore referred to for details of blank 29 in FIG. 20.

In the embodiments shown in the accompanying drawings, longitudinal edges 10, 16 and transverse edges 11, 17 are all square, sharp edges. In an alternative embodiment not shown, some longitudinal edges 10, 16 and/or some transverse edges 11, 17 are non-square, rounded or bevelled edges. For example, longitudinal edges 10, 16 may all be non-square, rounded or bevelled edges, or (as in the packet of cigarettes described in Patent Application EP-A1-0764595), major transverse edges 11, 17 may all be non-square, rounded or bevelled edges. Alternatively, some longitudinal edges 10, 16 and some transverse edges 11, 17 may be non-square, rounded edges, so as to have non-square, rounded or bevelled longitudinal edges 10, 16 and transverse edges 11, 17.

In a different embodiment not shown, packet 1 may resemble the packet of cigarettes described in Patent Application EP-A1-1066206; in which case, each major lateral wall 6, 12 is outwardly convex, and comprises a flat central portion, and two curved lateral fold strips connecting the flat central portion to minor lateral walls 7, 13 along respective sharp, non-square longitudinal edges 10, 16.

In another embodiment not shown, packet 1 may resemble the packet of cigarettes described in Patent Application IT-BO2001A000584; in which case, each major lateral wall 6, 12 is outwardly convex, and comprises a flat central portion, and two curved lateral fold strips connecting the flat central portion to walls 8, 9, 14, 15 along respective sharp, non-square transverse edges 11, 17.

Packet 1 as described above has various advantages: it is fast and easy to produce, provides for excellent mechanical protection of the cigarettes inside container 2, and can be opened quickly and easily. At the same time, lid 4 is substantially prevented from opening accidentally, however the packet is used.

Given the numerous advantages of packet 1 as described above, the form of packet 1 may also be applied integrally to the manufacture of other types of rigid containers for tobacco articles, such as cartons of packets of cigarettes, or cigar packets.

The invention claimed is:

1. A rigid package for tobacco articles, comprising:

a parallelepiped-shaped container (2) housing a group of tobacco articles and comprising a withdrawal opening (3), two major lateral walls (6), at least one minor lateral wall (7), a top wall (8) having the withdrawal opening (3), and a bottom wall (9); and a cup-shaped lid (4) comprising two major lateral walls (12), one minor lateral wall (13), a top wall (14), a bottom wall (15), and a hinge (5) to rotate, with respect to the container (2), between an open position and a closed position respectively opening and closing the withdrawal opening (3); the hinge (5) is parallel to the minor transverse edges (11) of the container (2) defined between the minor lateral wall (7) and the top and bottom walls (8, 9) and to the minor transverse edges (17) of the lid (4) defined between the minor lateral wall (13) and the top and bottom walls (14, 14);

the package (1) is characterized in that the major lateral walls (12) of the lid (4) are smaller than the major lateral walls (6) of the container (2); and the package (1) comprises stop means to limit rotation of the lid (4) with respect to the container (2) and so define a maximum open position of the lid (4).

2. The package (1) as claimed in claim 1, wherein the stop means comprise at least one first stop tab (21) projecting outwards of the container (2) from a major lateral wall (6) of the container (2); and a second stop tab (22) projecting inwards of the lid (4) from a major lateral wall (12) of the lid (4) and positioned to engage the first stop tab (21) as the lid (4) is opened.

3. The package (1) as claimed in claim 2, wherein the stop means comprise two first stop tabs (21), each located on a respective major lateral wall (6) of the container (2); and two second stop tabs (22), each located on a respective major lateral wall (12) of the lid (4).

4. The package (1) as claimed in claim 2, wherein each first stop tab (21) is formed by making an incision in a respective major lateral wall (6) of the container (2).

5. The package (1) as claimed in claim 2, wherein each first stop tab (21) is formed by removing a strip of material from a respective major lateral wall (6) of the container (2).

6. The package (1) as claimed in claim 1, wherein the stop means comprise a stop tab (41) located between the lid (4) and the container (2) and having one end hinged to the container (2) and an opposite end hinged to the lid (4).

7. The package (1) as claimed in claim 6, wherein the stop means comprise a first supporting tab (42) connected longitudinally and seamlessly to a major lateral wall (6) of the container (2) and hinged transversely to the stop tab (41); and a second supporting tab (43) glued to an inner surface of the minor lateral wall (13) of the lid (4) and hinged transversely to the stop tab (41).

8. The package (1) as claimed in claim 1, wherein the bottom wall (9) of the container (2) is bounded by two minor transverse edges (11) defined between the bottom wall (9) and two minor lateral walls (7); the hinge (5) being located on the bottom wall (9) of the container (2), in an intermediate position between the two minor transverse edges (11) bounding the bottom wall (9).

9. The package (1) as claimed in claim 1, wherein the withdrawal opening (3) extends over part of the top wall (8) of the container (2) and over part of the major lateral walls (6) of the container (2).

10. The package (1) as claimed claim 1, wherein the withdrawal opening (3) is at least partly closed by a tear-off portion (23) of the container (2).

11. The package (1) as claimed in claim 10, wherein the tear-off portion (23) closes the withdrawal opening (3) completely.

12. The package (1) as claimed in claim 10, wherein the tear-off portion (23) only closes part of the withdrawal opening (3).

13. The package (1) as claimed in claim 1, wherein the lid (4) comprises a top wall (14) covering the withdrawal opening (3) when the lid (4) is in the closed position; a bottom wall (15) opposite and parallel to the top wall (14); two major lateral walls (12); and a minor lateral wall (13) having at least one through hole large enough to permit insertion of a user's finger.

14. The package (1) as claimed in claim 1, wherein the top wall (14) of the lid (4) is larger than the bottom wall (15) of the lid (4).

15. The package (1) as claimed in claim 14, wherein each major lateral wall (12) of the lid (4) has a bevelled bottom portion.

16. The package (1) as claimed in claim 1, wherein the lid (4) is glued to the bottom wall (9) of the container (2) and comprises a connecting tab (20) separated from the lid (4) by a fold line defining the hinge (5), and which is glued entirely to the bottom wall (9) of the container (2).

17. The package (1) as claimed in claim 16, wherein the lid (4) comprises a top wall (14) covering the withdrawal opening (3) when the lid (4) is in said closed position; and a bottom wall (15) opposite and parallel to the top wall (14) and contacting the bottom wall (9) of the container (2) when the lid (4) is in the closed position; the connecting tab (20) being glued to the bottom wall (9) of the container (2) so as to be interposed between the bottom wall (9) of the container (2) and the bottom wall (15) of the lid (4) when the lid (4) is in the closed position.

18. The package (1) as claimed in claim 1, wherein the container (2) is formed by folding a first flat blank (18) having two longitudinal fold lines (24), and a number of transverse fold lines (25) defining, between the longitudinal fold lines (24):

a first panel (8') defining part of the top wall (8);

a second panel (6') defining one major lateral wall (6);

a third panel (9') defining the bottom wall (9);

a fourth panel (6') defining the other major lateral wall (6); and a fifth panel (8") defining the rest of the top wall (8);

the second panel (6') and the fourth panel (6') each having two wings (7'), which define respective parts of two minor lateral walls (7), are located on opposite sides of the respective second or fourth panel (6', 6'), and are separated from the respective second or fourth panel (6', 6') by the longitudinal fold lines (24).

19. The package (1) as claimed in claim 18, wherein a first wing (7') of the fourth panel (6') has two tabs (26) separated from the fourth panel (6') by the transverse fold lines (25); and a second wing (7') of the fourth panel (6') has one tab (26) separated from the fourth panel (6') by a transverse fold line (25) and substantially aligned with the third panel (9').

20. The package (1) as claimed in claim 1, wherein the lid (4) is formed by folding a second flat blank (19) having two transverse fold lines (27), and a number of longitudinal fold lines (28) defining, between the transverse fold lines (27):

a first panel (12') defining one major lateral wall (12);

a second panel (13') defining the minor lateral wall (13); and a third panel (12') defining the other major lateral wall (12).

21. The package (1) as claimed in claim 20, wherein the first panel (12') has two first wings (14', 15') located at opposite ends of the first panel (12'), separated from the first panel (12') by the transverse fold lines (27), and defining respective inner portions of the top and bottom walls (14, 15);

the second panel (13') has two second wings (14", 15") located at opposite ends of the second panel (13'), separated from the second panel (13') by the transverse fold lines (27), and defining respective inner portions of the top and bottom walls (14, 15); and the third panel (12') has two third wings (14''', 15''') located at opposite ends of the third panel (12'), separated from the third panel (12') by the transverse fold lines (27), and defining respective outer portions of the top and bottom walls (14, 15).

22. The package (1) as claimed in claim 21, wherein the first and second wings (14', 15', 14", 15") are shaped so as not to overlap when folded onto the third wings (14''', 15''') to define the top and bottom walls (14, 15) of the lid (4).

23. The package (1) as claimed in claim 20, wherein the lid (4) is glued to the bottom wall (9) of the container (2) and comprises a connecting tab (20), which is separated from the lid (4) by a fold line defining the hinge (5), is glued entirely to the bottom wall (9) of the container (2), and is connected to a first wing (15') of the first panel (12').

24. The package (1) as claimed in claim 1, wherein the container (2) and the lid (4) are formed by folding two respective independent separate blanks (18, 19; 29, 30).

25. The package (1) as claimed in claim 24, wherein a separating line (39) extends partly along a first blank (29) and separates the component parts of the container (2) from the component parts of the lid (4).

26. The package (1) as claimed in claim 25, wherein most of the separating line (39) defines an actual separation, while parts of the separating line (39) define a preformed tear line.

27. The package (1) as claimed in claim 1, wherein the lid (4) is glued to the bottom wall (9) of the container (2).

28. The package (1) as claimed in claim 1, and comprising a retaining device (32) for retaining the lid (4) in the closed position with a given force, so as to require greater force to open the lid (4).

29. The package (1) as claimed in claim 28, wherein the retaining device (32) comprises a deformable tab (33) at one edge of the top wall (14) of the lid (4), and a seat (34) formed on the top wall (8) of the container (2); in actual use, the tab (33) is inserted inside the seat (34) and, to be extracted from the seat (34), must be deformed by applying a given force.

30. The package (1) as claimed in claim 1, wherein the lid (4) is connected seamlessly to the container (2).

31. The package (1) as claimed in claim 1, wherein the container (2) has no minor lateral wall (7) at the lid (4), and so only comprises the minor lateral wall (7) on the opposite side to the lid (4).

32. The package (1) as claimed in claim 1, wherein the major lateral walls (6) and the top wall (8) of the container (2) are formed by superimposing two panels of two different separate independent blanks (29, 30).

33. The package (1) as claimed in claim 31, wherein the major lateral walls (6) and the top wall (8) of the container (2) comprise recesses (31) formed using only one panel in those areas, and which make the lid (4) easier to open by enabling a user to push the edges of the lid (4).

34. The package (1) as claimed in claim 1, wherein the container (2) and the lid (4) are formed by folding a first flat blank (29) and a second flat blank (30); the first blank (29) comprises two longitudinal fold lines (35), and a number of transverse fold lines (36) defining, between the two longitudinal fold lines (35):

a first panel (8', 14') defining part of the top wall (8) of the container (2) and part of the top wall (14) of the lid (4);

a second panel (6', 12') defining one major lateral wall (6) of the container (2) and one major lateral wall (12) of the lid (4);

a third panel (9', 15') defining the bottom wall (9) of the container (2) and the bottom wall (15) of the lid (4);

a fourth panel (6', 12') defining the other major lateral wall (6) of the container (2) and the other major lateral wall (12) of the lid (4); and a fifth panel (8", 14") defining the rest of the top wall (8) of the container (2) and the rest of the top wall (14) of the lid (4).

35. The package (1) as claimed in claim 34, wherein each second and fourth panel (6', 12') has two wings (7', 13'), which define respective parts of the minor lateral wall (7) of the container (2) and of the minor lateral wall (13) of the lid (4), are located on opposite sides of the second or fourth panel (6', 12'), and are separated from the second or fourth panel (6', 12') by longitudinal fold lines (35).

36. The package (1) as claimed in claim 35, wherein a wing (7') of one second or fourth panel (6', 12') has two tabs (37) separated from the wing (7') by transverse fold lines (36); and the other wing (13') of the same second or fourth panel (6', 12') has two tabs (38) separated from the wing (13') by transverse fold lines (36).

37. The package (1) as claimed in claim 34, wherein the hinge (5) extends along the third panel (9', 15') and separates the component parts of the container (2) from the component parts of the lid (4).

38. The package (1) as claimed in claim 34, wherein a separating line (39) extends along the first (8', 14') second (6', 12'), fourth (6', 12'), and fifth panel (8", 14") and separates the component parts of the container (2) from the component parts of the lid (4).

39. The package (1) as claimed in claim 38, wherein most of the separating line (39) defines an actual separation, while parts of the separating line (39) define a preformed tear line.

40. The package (1) as claimed in claim 39, wherein a stop tab (22) of the stop means is formed in each second or fourth panel (6', 12'), and is bounded on one side by the separating line (39) and on the other side by a longitudinal fold line (35).

41. The package (1) as claimed in claim 34, wherein the second blank (30) comprises:

a central panel (8'''), which defines an inner part of the top wall (8) of the container (2); and two end panels (6"), which define respective inner parts of the major lateral walls (6) of the container (2), are located at opposite ends of the central panel (8'''), and are separated from the central panel (8''') by two transverse fold lines (36).

42. The package (1) as claimed in claim 41, wherein each end panel (6") has a stop tab (21), which is separated from the end panel (6") by a longitudinal fold line (35).

43. The package (1) as claimed in claim 1, wherein the container (2) and the lid (4) are formed by folding a first flat blank (29) and a second flat blank (30); the first blank (29) comprises two transverse fold lines (36), and a number of longitudinal fold lines (35) defining, between the two transverse fold lines (36):

a first panel (13') defining part of the lateral wall (13) of the lid (4);

a second panel (6', 12') defining one major lateral wall (6) of the container (2) and one major lateral wall (12) of the lid (4);

a third panel (7') defining a minor lateral wall (7) of the container (2);

a fourth panel (6', 12') defining the other major lateral wall (6) of the container (2) and the other major lateral wall (12) of the lid (4); and a fifth panel (13') defining the rest of the lateral wall (13) of the lid (4).

44. The package (1) as claimed in claim 43, wherein each second or fourth panel (6', 12') has two wings (8', 14'), which define respective parts of the top wall (8) of the container (2) and part of the top wall (14) of the lid (4), are located at opposite ends of the second or fourth panel (6', 12'), and are separated from the second or fourth panel (6', 12') by transverse fold lines (36).

45. The package (1) as claimed in claim 44, wherein each wing (8', 14') of one second or fourth panel (6', 12') has two tabs (40) located on opposite sides of the wing (8', 14') and separated from the wing (8', 14') by longitudinal fold lines (35).

* * * * *